US006648926B1

(12) United States Patent
Immediato

(10) Patent No.: US 6,648,926 B1
(45) Date of Patent: Nov. 18, 2003

(54) PROCESS FOR TREATING KNITS CONTAINING POLYESTER BICOMPONENT FIBERS

(75) Inventor: Robert Francis Immediato, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 176 days.

(21) Appl. No.: 09/708,215

(22) Filed: Nov. 8, 2000

(51) Int. Cl.[7] ..... D06F 3/00; D06F 5/00; D06C 15/00; D06C 21/00

(52) U.S. Cl. ..... 8/512; 8/922; 8/924; 8/932; 8/933; 442/182; 442/199

(58) Field of Search ..... 8/922, 924, 932, 8/933, 512; 442/182, 199

(56) References Cited

U.S. PATENT DOCUMENTS

| | | | | | |
|---|---|---|---|---|---|
| 3,454,460 | A | * | 7/1969 | Bosley | 161/173 |
| 4,060,968 | A | * | 12/1977 | Barbe et al. | 54/140 |
| 4,115,989 | A | * | 9/1978 | Spolnicki | 57/140 |
| 4,195,051 | A | * | 3/1980 | Frankfort et al. | 264/176 |
| 5,102,724 | A | * | 4/1992 | Okawahara et al. | 428/224 |
| 5,874,372 | A | | 2/1999 | Morishita et al. | 442/182 |
| 6,276,121 | B1 | * | 8/2001 | Nabeshima et al. | 57/245 |
| 6,284,370 | B1 | * | 9/2001 | Fujimoto et al. | 428/364 |
| 6,306,499 | B1 | * | 10/2001 | Ochi et al. | 428/364 |
| 6,322,886 | B2 | * | 11/2001 | Branum | 428/365 |
| 6,333,106 | B2 | * | 12/2001 | Howell et al. | 428/364 |
| 2002/0045395 | A1 | * | 4/2002 | Lintecum et al. | 44/304 |

FOREIGN PATENT DOCUMENTS

| | | | |
|---|---|---|---|
| EP | 0 987 358 | 8/1999 | |
| JP | 58-115144 | 7/1983 | D03D/15/00 |
| JP | 61-32404 | 7/1986 | D01F/8/14 |
| JP | 63-42021 | 8/1988 | D03D/15/00 |
| JP | 5-295634 | 11/1993 | D03D/15/00 |
| JP | 11-189923 | 7/1999 | D01F/8/14 |

OTHER PUBLICATIONS

Dyeing and Chemical Technology of Textile Fibers, 6th Edition, Trotman, E.R., pp. 113–118.*

* cited by examiner

*Primary Examiner*—Yogendra N. Gupta
*Assistant Examiner*—Eisá Elhilo

(57) ABSTRACT

A process for improving the properties of knit fabrics containing bicomponent polyester fibers, by heat-setting the fabrics, while stretched cross-directionally, prior to dyeing, is provided.

6 Claims, No Drawings

PROCESS FOR TREATING KNITS CONTAINING POLYESTER BICOMPONENT FIBERS

BACKGROUND OF THE INVENTION

1. Field of the Invention

The present invention relates to a method of heat-setting fabrics containing bicomponent fibers comprising poly (ethylene terephthalate) and poly(trimethylene terephthalate).

2. Description of Background Art

Fabrics containing poly(ethylene terephthalate) fibers can be heat-set in order to stabilize their dimensions, for example at about 350–360° F. (177–182° C.), but such fabrics exhibit little or none of the stretch-and-recovery which has become increasingly desirable.

Polyester bicomponent fibers having latent crimp can also be used in making stretch fabrics, for example as described in Japanese Patent JP61-32404 and U.S. Pat. No. 5,874,372. However, not all such bicomponent fibers have adequate stretch-and-recovery properties, and fabrics made from such fibers can also have undesirable characteristics such as poor dye washfastness and uneven surface appearance.

Japanese Published Patent Applications JP58-115144, JP11-189923, and JP05-295634 and Japanese Patent JP63-42021 disclose various processes for treating fabrics comprising bicomponent fibers made from poly(ethylene terephthalate) and other polyesters, copolyesters, or poly (ethylene terephthalate) having a different molecular weight. However, these fibers generally have inadequate crimp, and the methods require excessively high temperatures, additional twisting of the bicomponent fibers, and/or two heat-setting steps, in order to obtain the desired flat but stretchy fabric. Such additional processing of fiber and/or fabric is inefficient and costly, and an improved method of making stretch fabrics comprising polyester bicomponent fibers is needed.

SUMMARY OF THE INVENTION

A process for treating a knit fabric comprising a plurality of self-crimping bicomponent fibers comprised of poly (ethylene terephthalate) and poly(trimethylene terephthalate) and having a crimp contraction value ($CC_a$) of at least about 10%, comprising the steps of:

a) stretching the fabric cross-directionally by about 1–15% based on the dry width of the fabric;

b) heat-setting the stretched fabric by dry heat-setting at a temperature of about 160–177° C. for a period of about 20–60 seconds or steam heat-setting at a temperature of about 120–145° C. for a period of about 3–40 seconds;

c) dyeing the fabric; and d) drying the fabric without heat-setting it further.

DETAILED DESCRIPTION OF THE INVENTION

As used herein, "self-crimping" refers to the ability of certain polyester bicomponent fibers spontaneously to form a spiral crimp when drawn, heat-treated and allowed to relax. Additional crimp, beyond that generated by drawing and heat-treating the fiber, can be created during hot-wet finishing of the fabric, for example during dyeing. Such fibers can be knit and woven to create stretch fabrics, for example into tricot, double knit, plain woven, and twill constructions.

As used herein, "bicomponent fiber" means a fiber comprising a pair of polymers adhered to each other along the length of the fiber, so that the fiber cross-section is a side-by-side or eccentric sheath-core cross section.

It has now been unexpectedly found that use of a single heat-setting step in a specific temperature range, carried out on woven or knit fabrics comprising certain self-crimping bicomponent fibers, under low cross-direction tension, and before dyeing, results in fabrics having a highly desirable combination of high recovery from stretching ("unload power"), excellent dye washfastness, and a smooth surface appearance and hand.

The polyester bicomponent fibers used to make the fabrics treated by the present process comprise poly(ethylene terephthalate) and poly(trimethylene terephthalate), which can be in a side-by-side or eccentric sheath/core relationship; side-by-side is preferred for maximum crimp development. The weight ratio of the two components is about 70:30 to 30:70. The bicomponent fibers have a crimp contraction value, as hereinafter defined, of at least about 10%. In the fibers, it is preferred that poly(ethylene terephthalate) have a lower intrinsic viscosity (IV) than poly(trimethylene terephthalate). It is not required to twist the bicomponent fibers in order to make the fabrics to be treated, and in fact it is preferred that such a twist not be introduced, since it requires an additional step and therefore generates additional cost.

Optionally, either or both components of the fibers of the fabrics treated by the present process can incorporate comonomers, as long as the beneficial effects of the invention are not adversely affected. For example, the poly (ethylene terephthalate) can incorporate comonomers selected from the group consisting of linear, cyclic, and branched aliphatic dicarboxylic acids having 4–12 carbon atoms (for example, butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4–10 carbon atoms (for example, hydroquinone bis(2-hydroxyethyl) ether, or a poly(ethyleneether) glycol having a molecular weight below about 460, including diethyleneether glycol). Isophthalic acid, pentanedioic acid, hexanedioic acid, 1,3-propane diol, and 1,4-butanediol are preferred because they are readily commercially available and inexpensive. Isophthalic acid is more preferred because copolyesters derived from it discolor less than copolyesters made with some other comonomers. The comonomer can be present in poly(ethylene terephthalate) at a level of about 0.5–15 mole percent.

Further, the fiber of the invention can contain minor amounts of other comonomers in one or both components, provided such comonomers do not adversely affect the level of fiber crimp or other properties. Such other comonomers include 5-sodium-sulfoisophthalate, at levels of about 0.2–5 mole percent. Very small amounts of trifunctional comonomers, for example trimellitic acid, can be incorporated for viscosity control.

The fabrics to be treated can also include wool, cotton, acetate, rayon, and other suitable fibers along with the polyester bicomponent fibers. Weft (circular and flat bed) and warp knit fabrics can be used in the process of the invention.

In the process of the invention, the heat-setting can be carried out dry or with steam. Dry heat-setting temperatures of about 320–355° F. (160–179° C.), preferably 165–175° C., are used, and the heat-setting time is about 20–60 seconds. Steam setting is carried out at about 248–293° F. (120–145° C.), preferably 120–130° C., for about 3 to 40 seconds. In either case, the longer times can be used at the lower temperatures, and the shorter times can be used at the higher temperatures. During heat-setting, the fabric is kept stretched in the cross-direction by about 1–15%, based on the dry width of the fabric. This is done in order to avoid crepe in the final fabric. By "1%" stretch is meant restraint to prevent relaxation during heat-setting; in practice, this means just sufficient tension (stretch) to hold the fabric or apparel on the heat-setting equipment. When the bicomponent fiber has a low crimp contraction value (as defined below), the cross-direction stretch can be low (but within the stated range), and when the fiber has a high crimp contraction value, the stretch can be higher (again within the stated range). The tension (stretch) applied can be used to adjust the finished fabric weight and stretch. Heat setting can be carried out in fabric or apparel form and with any suitable equipment, for example a tenter frame or boarding form.

Dyeing of the heat-set fabric can be conducted with any suitable dye, for example, disperse or acid dyes, by any suitable means, for example beck, paddle, or jet dyeing, and at any temperature appropriate for the particular dye being used.

Drying of the dyed fabric is conducted at sufficiently low temperatures (for example, less than about 145° C.) to avoid further heat-setting.

Steam-relaxation before heat-setting can be advantageous to reduce picking and running of the greige fabric when the crimp contraction value of the bicomponent fiber is low, for example, less than 30% as in Examples 3–6. Such steam-relaxation can be performed by any suitable means, for example with a semi-decator, a steam compactor or a tubular steamer.

Tensile properties of the bicomponent fibers were measured according to ASTM D2256 using a 10-inch (25.4-cm) gauge length sample at 65% RH and 70° F. at an elongation rate of 60% per minute. Tenacity and initial modulus are reported in deciNewtons per tex, and elongation-at-break as a percentage.

Intrinsic viscosity (IV) of the fiber was measured by exposing polymer to the same process conditions as polymer actually spun into bicomponent fiber except that the test polymer was spun through a sampling spinneret (which did not combine the two polymers into a single fiber) and then collected for IV measurement.

Unless otherwise noted, crimp contraction values in the bicomponent fiber made and used in the Examples were measured as follows. Each sample was formed into a skein of 5000+/−5 total denier (5550 dtex) with a skein reel at a tension of about 0.1 gram per denier (gpd) (0.09 dN/tex). The skein was conditioned at 70+/−2° F. (21+/−1° C.) and 65+/−2% relative humidity for a minimum of 16 hours. The skein was hung substantially vertically from a stand, a 1.5 mg/den (1.35 mg/dtex) weight (e.g. 7.5 grams for a 5550 dtex skein) was hung on the bottom of the skein, the weighted skein was allowed to come to an equilibrium length, and the length of the skein was measured to within 1 mm and recorded as "$C_b$". This 1.35 mg/dtex weight was left on the skein for the duration of the test. Next, a 500-gram weight (100 mg/d; 90mg/dtex) was hung from the bottom of the skein, and the length of the skein was measured to within 1 mm and recorded as "$L_b$". Crimp contraction value (%) (before heat-setting, as described below for this test), "$CC_b$", was calculated according to the formula $CC_b=100\times(L_b-C_b)/L_b$. The 500 g-weight was removed, and the skein was then hung on a rack and heat-set, with the 1.35-mg/dtex weight still in place, in an oven for 5 minutes at about 225° F. (107° C.), after which the rack and skein were removed from the oven and conditioned as above for two hours. This step was designed to simulate commercial dry heat-setting, which is one way to develop the final crimp in the bicomponent fiber. The length of the skein was measured as above, and its length was recorded as "$C_a$". The 500-gram weight was again hung from the skein, and the skein length was measured as above and recorded as "La". The after heat-set crimp contraction value, "$CC_a$", was calculated according to the formula $CC_a=100\times(L_a-C_a)/L_a$.

To determine dye washfastness, pieces of the fabrics treated by the process of the invention were given a standard wash stain test (American Association of Textile Chemists and Colorists Test Method 61-1996, "Color Fastness to Laundering, Home and Commercial: Accelerated"; 2A version at 122° F. (50° C.)), which is intended to simulate five washes at low-to-moderate temperatures. The test was run in the presence of a nylon 6,6 knit fabric, and the degree of staining of the nylon was visually rated.

To determine fabric stretch, three specimens of 3 in×8 in (7.6 cm×20.3 cm) were cut from the fabric and folded in the middle to form an open loop. The long dimension of each specimen was the dimension tested. The fabric cross-direction (CD) and machine-direction (MD) stretch were tested on separate samples. Unload Power was tested on the cross-direction sample. Each open loop was stitched together about 1 inch (2.5 cm) from its ends to form a closed loop 6 inches (15.2 cm) in circumference. The mechanical properties of the fabric loops were tested with an Instron tensile tester with a 6-inch (15.2 cm) cross head, pneumatic clamps (size 3C, having 1 in×3 in (2.5×7.6 cm) flat faces, 80 psi (552 kPa) air supply), and 10 inches per minute (25.4 cm/min) chart speed. A u-shaped rod was clamped sideways between one of the sets of clamps of the tensile tester so that the ends of the rod [(2.78 in (7 cm) between the ends, 3 in (7.6 cm) around the ends)] projected from the clamps far enough to hold the fabric loop securely. The loop was placed around the projecting rod ends and stretched to a 12-pound (5.4 kg) force and relaxed; the cycle was performed a total of 3 times. "Fabric stretch" was measured on the $3^{rd}$ cycle extension at 12-pound (5.4 kg) force, and unload power was measured at 30% remaining available stretch on the $3^{rd}$ cycle relaxation. "30% remaining available stretch" means that the fabric had been relaxed 30% from 12-pound (5.4 kg) force. In order to compare fabrics of different basis weights, unload power was normalized by dividing the as-determined value by the fabric weight.

For Examples 1 and 2, 149 denier (165 dTex), 68 filament bicomponent yarn was prepared by melting poly (trimethylene terephthalate) (60 wt %, IV=1.27 dl/g) and poly(ethylene terephthalate) (40 wt %, IV=0.54 dl/g) in independent melt systems at about 280° C., transporting the polymers to a spinneret, and spinning them side-by-side into a cross-flow quench provided with about 100 cfm (2.8 cubic meters per minute) of air. Each component contained 0.3 wt % $TiO_2$. An organic ester-based finish emulsion was applied (5 wt %) to the yarn. The yarn was passed around a feedroll, through a steam draw jet, and then around a second roll to provide a draw ratio of 2.8. The yarn was then passed through a 165° C. hot chest containing two rolls to provide a second draw ratio of 1.3. A total of 7.5 wraps were taken between the two rolls in the hot chest. The yarn was passed around a puller roll, through dual interlace jets, and then around a letdown roll. Finish was then reapplied (5 wt %) to the yarn. The yarn was then wound onto a paper core tube. The resulting fibers had a tenacity of 3.5 g/d (3.1 dN/tex), elongation-to-break of 15%, and a crimp contraction ($CC_a$) value of about 46–50%.

In Examples 1 and 2, each fabric was a single jersey knit prepared on a 28 gauge, 24 position circular knitting machine with 255 inches (648 cm) course length per revolution and contained only the bicomponent yarn.

EXAMPLE 1

The single jersey knit fabric was slit open and dry heat-set at about 330° F. (166° C.) on a tenter frame for about 30 seconds with about 5% cross-direction stretch (based on the dry width of the fabric) and about 5% machine direction overfeed. For scouring, dyeing, rinsing, and reductive scouring, a 12-liter paddle dyer (Werner-Mathis JFO model) was used. 175 grams of the heat-set fabric was scoured for 20 minutes at 160° F. (71° C.) in a solution of 0.5 g/l of Merpol® LFH (a low-foaming nonionic surfactant; registered trademark of E.I. du Pont de Nemours and Company) and 0.5 g/l of trisodium phosphate in water. The dyer and fabric were rinsed with a fresh water overflow. The dyer was drained and refilled with 1.0 wt % Merpol® LFH, based on weight of fabric, set to 110° F. (430° C.), and operated for 5 min. Then 1.5 wt % Dispersol Rubine XF (BASF; 100% form) (based on the weight of the fabric) was added, and the pH was adjusted to 4.5 using acetic acid. The temperature was raised at a rate of 3° F. (1–2° C.)/min, and the dyer was operated for 30 minutes at 255° F. (124° C.). The dyebath was cooled to 170° F. (77° C.), and the dyer and fabric were rinsed with a fresh water overflow. The dyer was then drained, refilled with an aqueous solution containing 4 g/l sodium dithionite (Polyclear NPH, Henkel Corp.) and 3 g/l soda ash, set to 160° F. (71° C.), and operated for 20 minutes. The fabric and dyer were rinsed with a fresh water overflow, then operated for 10 minutes with a room-temperature solution of 1.0 g/l acetic acid, and then rinsed again with fresh water overflow. The fabric was removed from the dyer, and excess water was removed by pulling the fabric over a slit in a vacuum pipe. The fabric was dried at about 250° F. (121° C.) at a width one inch (2.5 cm) wider than the width of the wet fabric, as it was removed from the dyer. Properties of the fabric are summarized in Table I; where CD is cross-direction and MD is machine-direction.

EXAMPLE 2 (COMPARISON)

The fabric was treated substantially as in Example 1 but without heat-setting before dyeing. After being dried as in Example 1, the fabric was dry heat-set at about 330° F. (166° C.) for about 30 seconds substantially as in Example 1. The properties of this treated fabric are also summarized in Table I.

TABLE I

| | Example 1 | Example 2 (Comparison) |
|---|---|---|
| Hand | Light, silky | Harsh |
| Appearance | Flat, smooth | Rough, orange peel |
| Dye strike | Dye bath exhausted | Dye bath exhausted |
| Wash Fastness | Excellent | Fair |
| Fabric Weight | 4.86 oz/yd$^2$ (165 g/m$^2$) | 6.20 oz/yd$^2$ (210 g/m$^2$) |
| Fabric strenght, % (CD; MD) | 106; 81 | 04; 108 |
| Unload Power | 0.113 lb-yd$^2$/oz (1.51 kg-m$^2$/Kg) | 0.097 lb/yd$^2$/oz (1.30 kg-m$^2$/Kg) |

The results in Table I show that the hand, appearance, and dye washfastness of fabrics comprising poly(trimethylene terephthalate)//poly(ethylene terephthalate) bicomponent fibers were unexpectedly improved when heat-setting was conducted before rather than after dyeing. Further, the fabric weight is desirably lower and the unload power desirably higher. Reducing the cross-direction stretch and increasing the overfeed during heat-setting can result in a fabric with more symmetrical stretch properties if that were desired.

For Examples 3 through 6, 71 denier (79 dTex), 34-filament bicomponent yarns were prepared by melting, independently, poly(trimethylene terephthalate), 3-GT (IV=1.27 dl/g), containing 0.3 wt % $TiO_2$ in an extruder and transporting it to a spinneret at a melt temperature of about 278° C., and poly(ethylene terephthalate), 2-GT (IV=0.54 dl/g), also containing 0.3 wt % $TiO_2$, at about 290° C. and transporting to the spinneret. The components were spun into side-by-side bicomponent fibers at a weight ratio of 3-GT:2-GT=60/40 through a cross flow quench provided with 100 cfm (2.8 cubic meters/min) of air. An organic ester-based emulsion oil (5 wt % was applied to the filaments, which were then passed around a feed roll, across a heated plate operating at 200° C., and then around a second roll to provide a draw ratio of 2.0. The fibers were passed through a hot chest containing two rolls to provide a second draw ratio of 1.3. A total of 7.5 wraps were taken between the two hot chest rolls. The filaments were passed around a puller roll and through dual interlace jets around another roll. Finish was then reapplied (5 wt %), and the fibers were wound onto a paper core tube. The IV of the poly (trimethylene terephthalate) component of the bicomponent fiber was 0.96 dl/g, and that of the poly(ethylene terephthalate) component of the bicomponent fiber was 0.56 dl/g. The fibers had a tenacity of 3.3 g/d (2.9 dN/tex), an elongation-to-break of 31% and a crimp contraction value ($CC_a$) of 10–19%.

In each of Examples 3–6, the fabric was a double-knit interlock prepared with only the bicomponent yarn on a 20-gauge machine with a 137 inch (348 cm) course length. The fabric was steam-relaxed by pulling it across an open semi-decator for a few seconds.

EXAMPLE 3

The steam-relaxed fabric was slit open and dry heat-set at about 330° F. (166° C.) for about 45 seconds on a tenter frame at about the same width as after steam-relaxing with a 5%-machine direction overfeed. For scouring, dyeing, rinsing, and reductive scouring, a 12-liter paddle dyer (Werner-Mathis JFO model) was used. 175 grams of the heat-set fabric was scoured for 20 minutes at 160° F. (71° C.) in a solution of 0.5 g/l of Merpol® LFH and 0.5 g/l of trisodium phosphate. The dyer and fabric were rinsed with a fresh water overflow. The dyer was emptied, refilled with a solution of 1.0 wt % Merpol® LFH based on weight of fabric, set to 110° F. (43° C.), and operated for 5 min. Then 3.0 wt % Terasil Navy GRL 200 (Ciba Geigy) (based on weight of fabric) was added, and the pH was adjusted to 4.5 with acetic acid. The dyebath temperature was raised at a rate of 3° F. (1–2° C.)/minute, and the dyer was operated for 45 minutes at 255° F. (124° C.). The dyebath was cooled to 170° F. (77° C.), and the dyer and fabric were rinsed with a fresh water overflow. The dyer was drained, refilled with a solution of 4 g/l sodium dithionite (J.T. Baker, Inc.) and 3 g/l soda ash, set to 160° F. (71° C.), and operated for 20 minutes. The dyer and fabric were then rinsed with a fresh water overflow, rinsed for 10 minutes with a room-temperature solution of 1.0 g/l acetic acid, and rinsed again with a fresh water overflow. Excess water was removed from the fabric by pulling it over a slit in a vacuum pipe. The fabric was then dried at 250° F. (121° C.) at a width one inch wider than the wet width.

EXAMPLE 4

The process of Example 3 was repeated except that the fabric was heat-set at about 340° F. (171° C.). The washfastness was rated and is reported in Table II.

EXAMPLE 5

The process of Example 3 was repeated except that the fabric was heat-set at about 350° F. (177° C.). The washfastness was rated and-is reported in Table II.

EXAMPLE 6 (COMPARISON)

The process of Example 3 was repeated except that the fabric was heat-set at about 360° F. (182° C.). The washfastness was rated and is reported in Table II.

The depth of color on all of the fabrics of Samples 3–6 was substantially the same.

TABLE II

| | Dry Heat-set | | |
|---|---|---|---|
| Example | Temperature | Time | Washfastness |
| 3 | 330° F. (166° C.) | 45 sec | Excellent |
| 4 | 340° F. (171° C.) | 45 sec | Excellent |
| 5 | 350° F. (177° C.) | 45 sec | Good |
| 6 (Comp.) | 360° F. (182° C.) | 45 sec | Fair |

The data in Table II show that heat-setting at a temperature of about 320–350° F. (160–177° C.) gives good to excellent results, while use of higher temperatures gives only fair results. When Example 6 was repeated with Dispersol Rubine XF (a "high energy" dye having a high sublimation temperature; 1.5% based on weight of fabric), washfastness remained only fair.

EXAMPLE 7

For this Example, a 72-denier (80-dTex), 34-filament, side-by-side 60//40 poly(trimethylene terephthalate)//poly (ethylene terephthalate) yarn, spun from poly(trimethylene terephthalate) and poly(ethylene terephthalate), and having 0.3 wt % $TiO_2$ in each component, was used. The yarn had a crimp contraction value ($CC_a$) of about 45%, tenacity of 3.5 g/d (3.1 dN/tex), and elongation-to-break of 14%. The poly(trimethylene terephthalate) component of the bicomponent fiber had an IV of 0.94 dl/g, and poly(ethylene terephthalate) component of the bicomponent fiber had an IV of 0.54 dl/g. A jersey hosiery leg was knit with the yarn on a 4-position, 400 needle, 404 Lonati pattern knitting machine at 700 in/rev (17.8 meters per revolution) course length. The hose was steam-boarded for 4 seconds at 240° F. (116° C.) (Example 7a; Comparison) or 250° F. (121° C.) (Example 7b) on the leg form of a Fierson boarding machine and dried at 230° F. (110° C.) for 60 seconds. Fabric appearance is given in Table III.

EXAMPLE 8

Example 7 was repeated, except that a 48-denier, 34-filament yarn was spun from poly(ethylene terephthalate) and poly(trimethylene terephthalate). The fibers had a crimp contraction value ($CC_a$) of 40%, tenacity of 4.2 g/d (3.7d N/tex), and elongation of 18%. The poly(ethylene terephthalate) component of the bicomponent fiber had an IV=0.54 dl/g, and the poly(trimethylene terephthalate) component of the bicomponent fiber had an IV=0.89 dl/g. The hose was steam-boarded for 4 seconds at 250° F. (121° C.) (Example 8a) and 260° F. (127° C.) (Example 8b) and dried at 230° F. for 60 seconds. Fabric appearance is given in Table III.

TABLE III

| | Boarding Temperature | Fabric Appearance |
|---|---|---|
| 7a (Comp.) | 116° C. (240° F.) | Fair (some crepe) |
| 7b | 121° C. (250° F.) | Very good (smooth) |
| 8a | 121° C. (250° F.) | Very good (smooth) |
| 8b | 127° C. (260° F.) | Excellent (very smooth) |

Atmospheric dyeing or pressure dyeing after steam heat-setting did not alter the smoothness of the fabrics in Examples 7 or 8. The results summarized in Table III show that below about 120° C. steam-set temperature, a crepe appearance begins to be evident when setting is carried out before dyeing. At temperatures above about 120° C. (up to about 145° C., the practical upper limit for steam boarding equipment), the fabric surface is desirably smooth.

EXAMPLE 9 (COMPARISON)

Using the same fabric construction as in Example 8, a greige hosiery blank was immersed in boiling water for 10 minutes to simulate dyeing before boarding. The fabric appearance was extremely wrinkled and "crepey". The fabric could not be made smooth by steam-boarding after the simulated dyeing.

What is claimed is:

1. A process for treating a knit fabric comprising a plurality of self-crimping bicomponent fibers comprised of poly (ethylene terephthalate) and poly (trimethylene terephthalate), and having a crimp contraction value ($CC_a$) of at least about 10%, comprising the steps of:

(a) stretching the fabric cross-directionally by about 1–15% based on the dry width of the fabric;

(b) heat-setting the stretched fabric by dry heat-setting at a temperature of about 160–177° C. for a period of about 20–60 seconds or steam heat-setting at a temperature of about 120–145° C. for a period of about 3–40 seconds;

(c) dyeing the heat-setted fabric; and (d) drying the fabric at a temperature no higher than about 145° C.

2. The process of claim 1 wherein the poly (ethylene terephthalate) component of the bicomponent fiber has a lower intrinsic viscosity than the poly (trimethylene terephthalate) component of the bicomponent fiber, the dry heat-setting temperature is about 165–175° C., and the steam heat-setting temperature is about 120–130° C.

3. The process of claim 1 wherein the fiber has a side-by-side cross-section and a comonomer is incorporated in poly(ethylene terephthalate) at a level of about 0.5–15 mole %.

4. The process of claim 3 wherein the comonomer is selected from the group consisting of isophthalic acid, pentanedioic acid, hexanedioic acid, 1,3-propane diol, and 1,4-butanediol.

5. The process of claim 1 wherein the fabric further comprises fibers selected from the group consisting of cotton, rayon, acetate, and wool.

6. The process of claim 1 wherein a steam relaxation step is carried out before step (a).

* * * * *